US011030951B2

(12) United States Patent
Lee et al.

(10) Patent No.: US 11,030,951 B2
(45) Date of Patent: Jun. 8, 2021

(54) LIGHT-EMITTING DISPLAY AND METHOD OF DRIVING THE SAME

(71) Applicant: LG Display Co., Ltd., Seoul (KR)

(72) Inventors: Changwoo Lee, Paju-si (KR); Jaeik Yoo, Paju-si (KR); Osung Do, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/707,990

(22) Filed: Dec. 9, 2019

(65) Prior Publication Data

US 2020/0202777 A1 Jun. 25, 2020

(30) Foreign Application Priority Data

Dec. 19, 2018 (KR) ..... 10-2018-0165061

(51) Int. Cl.
*G09G 3/3275* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01); *G09G 2310/08* (2013.01); *G09G 2330/08* (2013.01); *G09G 2330/12* (2013.01)

(58) Field of Classification Search
CPC ..... G09G 3/3275
See application file for complete search history.

(56) References Cited

U.S. PATENT DOCUMENTS

| | | | | |
|---|---|---|---|---|
| 7,068,292 | B2 | 6/2006 | Morita | |
| 9,349,311 | B2 | 5/2016 | Yu et al. | |
| 9,542,873 | B2 | 1/2017 | Yu et al. | |
| 2003/0156104 | A1 | 8/2003 | Morita | |
| 2015/0048881 | A1* | 2/2015 | Kwon | H03H 19/004 327/554 |
| 2015/0379909 | A1 | 12/2015 | Yu et al. | |
| 2016/0240122 | A1* | 8/2016 | Yu | G09G 3/006 |
| 2018/0033366 | A1* | 2/2018 | Yoo | G09G 3/3233 |
| 2018/0136778 | A1* | 5/2018 | Choi | G06F 3/0412 |
| 2018/0137819 | A1* | 5/2018 | An | G09G 3/3233 |

FOREIGN PATENT DOCUMENTS

| | | | |
|---|---|---|---|
| JP | 2003-241717 | A | 8/2003 |
| KR | 10-2003-0068480 | A | 8/2003 |
| KR | 10-2009-0123281 | A | 12/2009 |
| KR | 10-1529005 | B1 | 6/2015 |
| KR | 10-2017-0080776 | A | 7/2017 |
| KR | 10-2018-0002099 | A | 1/2018 |

* cited by examiner

*Primary Examiner* — Roy P Rabindranath
(74) *Attorney, Agent, or Firm* — Fenwick & West LLP

(57) ABSTRACT

A light-emitting display includes a display panel, a first circuit, and a second circuit. The display panel comprises a pixel. The first circuit supplies a data voltage to a data line for the pixel. The second circuit performs a sensing operation for sensing a sensing line for the pixel and outputs a voltage required for the sensing operation, and outputs a noise removing voltage for cancelling out noise formed on the sensing line during the sensing operation.

14 Claims, 15 Drawing Sheets

LIGHT-EMITTING DISPLAY AND METHOD OF DRIVING THE SAME

This application claims the benefit of Republic of Korea Patent Application No. 10-2018-0165061, filed on Dec. 19, 2018, which is incorporated herein by reference for all purposes as if fully set forth herein.

BACKGROUND

Field

The present disclosure relates to a light-emitting display and a method of driving the same.

Related Art

The market for displays which act as an intermediary between users and information is growing with the development of information technology. Thus, display devices such as organic light-emitting displays (OLED), and quantum dot displays (QDP), liquid-crystal displays (LCD) are increasingly used.

Some of the aforementioned display devices comprise a display panel comprising sub-pixels, a drive part that outputs driving signals for driving the display panel, and a power supply part that generates electric power to be supplied to the display panel or drive part.

When driving signals, for example, a scan signal and a data signal, are supplied to sub-pixels on the display panel, the aforementioned display devices are able to display an image by allowing the selected sub-pixels to pass light therethrough or to emit light by themselves.

Notably, the light-emitting displays offer many advantages, including electrical and optical characteristics, such as fast response time, high brightness, and wide viewing angle, and mechanical characteristics such as flexibility. However, the light-emitting displays require ongoing research because there is a need for improvement in the configuration of a compensation circuit.

SUMMARY

The present disclosure provides a light-emitting display comprising a display panel, a first circuit, and a second circuit. The display panel comprises a pixel. The first circuit supplies a data voltage to a data line for the pixel. The second circuit performs a sensing operation for sensing a sensing line for the pixel and outputs a voltage required for the sensing operation, and outputs a noise removing voltage for cancelling out noise formed on the sensing line during the sensing operation.

In another aspect, the present disclosure provides a method of driving a light-emitting display comprising a display panel that displays an image during an active period and performs sensing during a blanking interval. The driving method of the light-emitting display comprises: turning on a switch part connected to a sensing line on the display panel during the blanking interval, outputting a noise removing voltage through the switch part, and sensing the sensing line.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Figure 1:
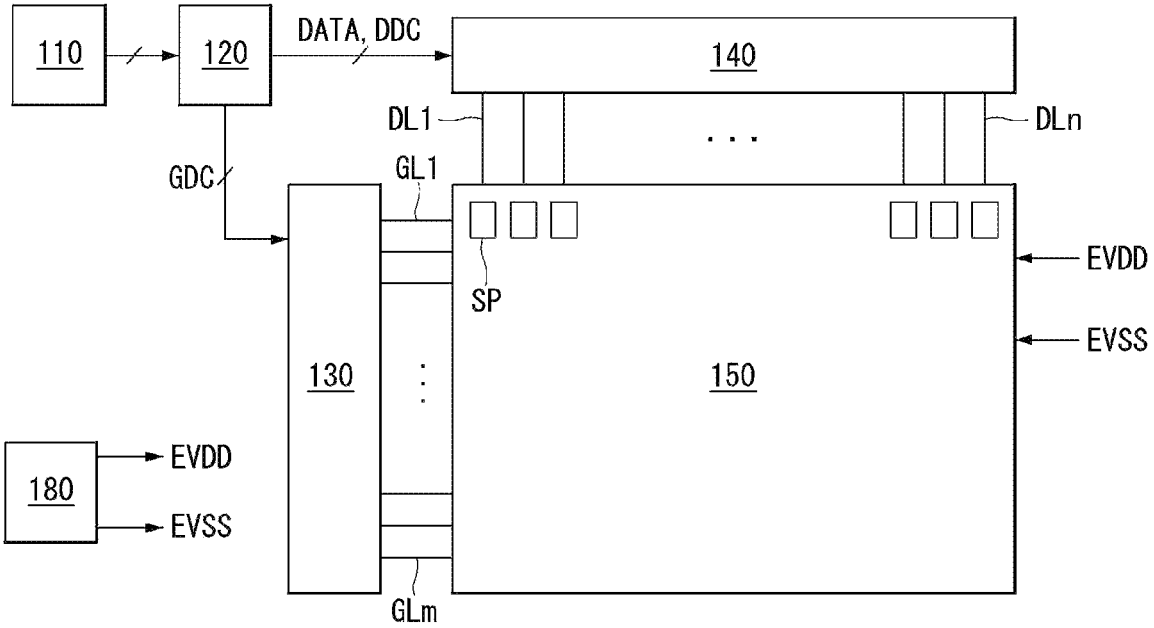
FIG. 1 is a schematic block diagram of an organic light-emitting display according to an exemplary embodiment of the present disclosure.

Reference will now be made in detail embodiments of the invention examples of which are illustrated in the accompanying drawings.

Hereinafter, concrete embodiments of the present disclosure will be described with reference to the accompanying drawings.

A light-emitting display according to the present disclosure may be implemented in televisions, video players, personal computers (PCs), home theaters systems, automotive electronics, smartphones, and so forth, but are not limited to them.

Moreover, a light-emitting display to be described below is applicable to an inorganic light-emitting display device using inorganic light-emitting diodes, as well as an organic light-emitting display device using organic light-emitting diodes. By way of example, the following description will be given of an organic light-emitting display device.

The organic light-emitting display device to be described below performs an image display operation and an external compensation operation. The external compensation operation may be performed for each sub-pixel or for each pixel. The external compensation operation may be performed during a vertical blanking interval in the image display operation, during a power-on sequence before the start of the image display operation, or during a power-off sequence after the end of the image display operation.

The vertical blanking interval is the time during which no data signals for image display are written, between each vertical active period during which 1 frame of data signals is written. The power-on sequence is a transition period from turning on the power for driving the device until displaying an image. The power-off sequence is a transition period from the end of display of an input image until turning off the driving power.

In an external compensation method for performing the external compensation operation, a driving transistor may be operated in a source-follower manner, and then the voltage (the source voltage of the driving TFT) stored in a line capacitor (parasitic capacitor) of a sensing line may be sensed. In the external compensation method, the source voltage may be sensed when the potential at the source node of the driving transistor goes into a saturated state (i.e., the current Ids of the driving TFT becomes zero), in order to compensate for variation in the threshold voltage of the driving transistor. Also, in the external compensation method, linear values may be sensed before the source node of the driving transistor reaches saturation, in order to compensate for variation in the mobility of the driving transistor.

Moreover, in the external compensation method, a current flowing through a sensing node defined between the source node of the driving transistor and the anode of the organic light-emitting diode may be sensed, in order to compensate for variation in the threshold voltage of the driving transistor. In addition, the charge accumulated in the parasitic capacitor of the organic light-emitting diode may be sensed, in order to compensate for degradation of the organic light-emitting diode. As above, in the external compensation method, the voltage stored in a line or electrode, the current flowing through a node, and the charge accumulated in the parasitic capacitor may be sensed, and degradation of an element included in the sub-pixel may be compensated for based on the sensed values.

In addition, although sub-pixels to be described below will be illustrated as comprising n-type thin-film transistors by way of example, they may comprise p-type thin-film transistors or both the n-type and p-type transistors. A thin-film transistor is a three-electrode device with gate, source, and drain. The source is an electrode that provides carriers to the transistor. The carriers in the thin-film transistor flow from the source. The drain is an electrode where the carriers leave the thin-film transistor. That is, the carriers in the thin-film transistor flow from the source to the drain.

In the case of the n-type thin-film transistor, the carriers are electrons, and thus the source voltage is lower than the drain voltage so that the electrons flow from the source to the drain. In the n-type thin-film transistor, current flows from the drain to the source. In contrast, in the case of the p-type thin-film transistor, the carriers are holes, and thus the source voltage is higher than the drain voltage so that the holes flow from the source to the drain. In the p-type thin-film transistor, since the holes flow from the source to the drain, current flows from the source to the drain. However, the source and drain of a thin-film transistor are interchangeable depending on the applied voltage. In this regard, in the description below, either the source or drain will be termed a first electrode, and the other will be termed a second electrode.

Figure 2:
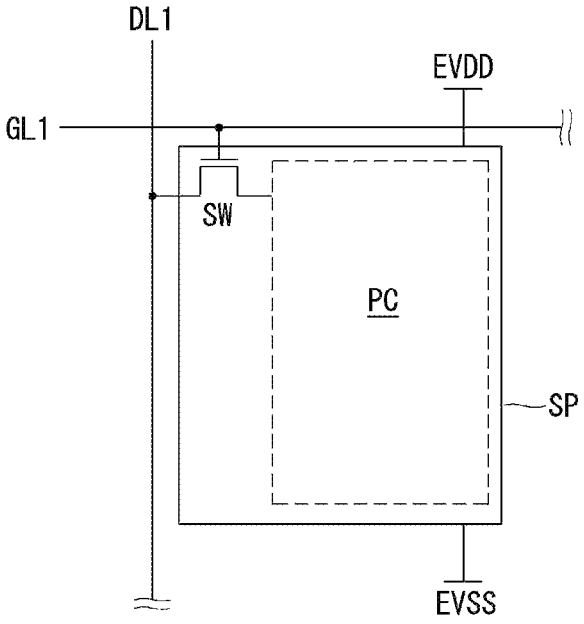
FIG. 2 is a schematic view of the configuration of a sub-pixel shown in FIG. 1 according to an embodiment of the present disclosure.

FIG. 1 is a schematic block diagram of an organic light-emitting display according to an exemplary embodiment of the present disclosure. FIG. 2 is a schematic view of the configuration of a sub-pixel shown in FIG. 1 according to an embodiment of the present disclosure.

As shown in FIGS. 1 and 2, the organic light-emitting display according to the exemplary embodiment of the present disclosure comprises an image providing part 110, a timing controller 120, a scan driver 130, a data driver 140, a display panel 150, and a power supply part 180.

The image providing part 110 (or host system) outputs various driving signals, along with a video data signal supplied from the outside or a video data signal stored in an internal memory. The image providing part 110 may supply a data signal and various driving signals to the timing controller 120.

The timing controller 120 outputs a gate timing control signal GDC for controlling the operation timing of the scan driver 130, a data timing control signal DDC for controlling the operation timing of the data driver 140, and various synchronization signals (a vertical synchronization signal Vsync and a horizontal synchronization signal Hsync).

The timing controller 120 supplies the data driver 140 with a data signal DATA supplied from the image providing part 110, along with a data timing control signal DDC. The timing controller 120 may be formed in the form of an IC (integrated circuit) and mounted on a printed circuit board, but is not limited thereto.

In response to the gate timing control signal GDC supplied from the timing controller 120, the scan driver 130 outputs a scan signal (or scan voltage). The scan driver 130 supplies a scan signal to sub-pixels included in the display panel 150 through scan lines GL1 to GLm. The scan driver 130 may be formed in the form of an IC (integrated circuit) or directly on the display panel 150 by the gate-in-panel (GIP) technology, but is not limited thereto.

In response to the data timing control signal DDC supplied from the timing controller 120, the data driver 140 samples and latches the data signal DATA, converts it to an analog data voltage corresponding to a gamma reference voltage, and outputs the analog data voltage.

The data driver 140 supplies the data voltage to sub-pixels included in the display panel 150 through data lines DL1 to DLm. The data driver 140 may be formed in the inform of an IC and mounted on the display panel 150 or on a printed circuit board, but is not limited thereto.

The power supply part 180 generates and outputs a high-potential first power EVDD and a low-potential second power EVSS based on an external input voltage supplied from the outside. The power supply part 180 may generate and output a voltage (e.g., scan-high voltage or scan-low voltage) required to run the scan driver 130 or a voltage (drain voltage or half-drain voltage) required to run the data driver 140, as well as the first and second powers EVDD and EVSS.

The display panel 150 displays an image, corresponding to the driving signals including the scan signal and data voltage outputted from the drive part comprising the scan driver 130 and data driver 140, and the first and second powers EVDD and EVSS outputted from the power supply part 180. The sub-pixels on the display panel 150 emit light by themselves.

The display panel 150 may be fabricated based on a rigid or flexible substrate of glass, silicon, polyimide, or the like. The sub-pixels which emit light may consist of red, green, and blue pixels, or may consist of red, green, blue, and white pixels.

For example, each sub-pixel SP comprises a pixel circuit PC which comprises a switching transistor SW, a driving transistor, a storage capacitor Cst, and an organic light-emitting diode, etc. The sub-pixels used in the organic light-emitting display have a complex circuit configuration since they emit light by themselves. Also, there are various compensation circuits that compensate for degradation of the organic light-emitting diodes, which emit light, and degradation of the driving transistors, which supply a driving current to the organic light-emitting diodes. As such, it should be noted that the pixel circuit PC in each sub-pixel SP comes in block form.

Although, in the above description, the timing controller 120, scan driver 130, data driver 140, etc. are described as if they were individual components, one or more among the timing controller 120, scan driver 130, and data driver 140 may be integrated in one IC depending on the method of implementation of the organic light-emitting display.

Figure 3:
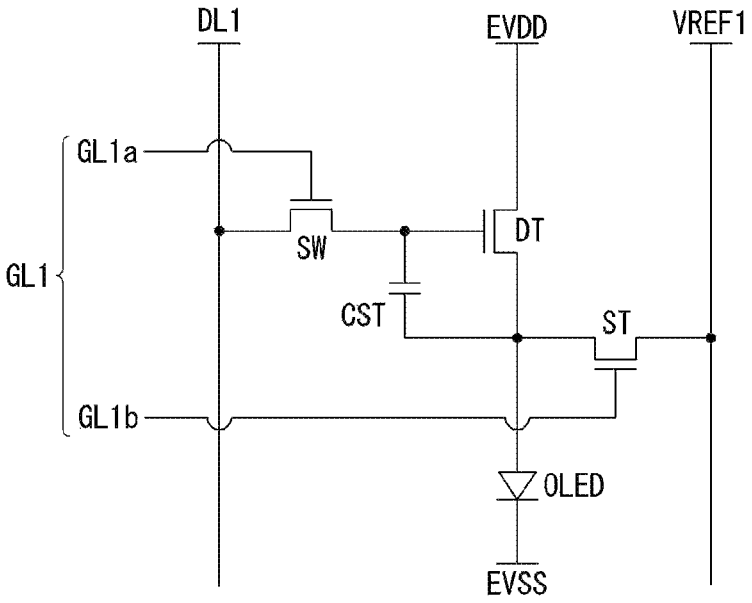
FIG. 3 is an equivalent circuit diagram showing a sub-pixel comprising a compensation circuit according to an exemplary embodiment of the present disclosure.
Figure 4:
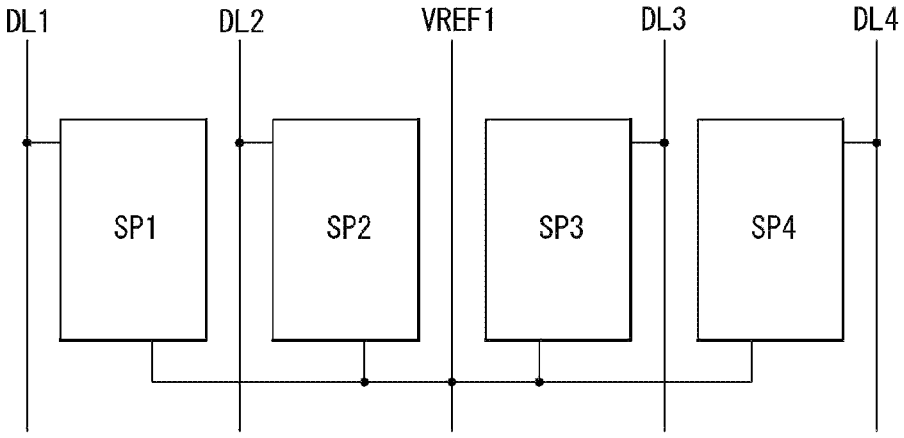
FIGS. 4 and 5 are exemplary views of a pixel that can be implemented based on the sub-pixel of FIG. 3 according to embodiments of the present disclosure.
Figure 5:
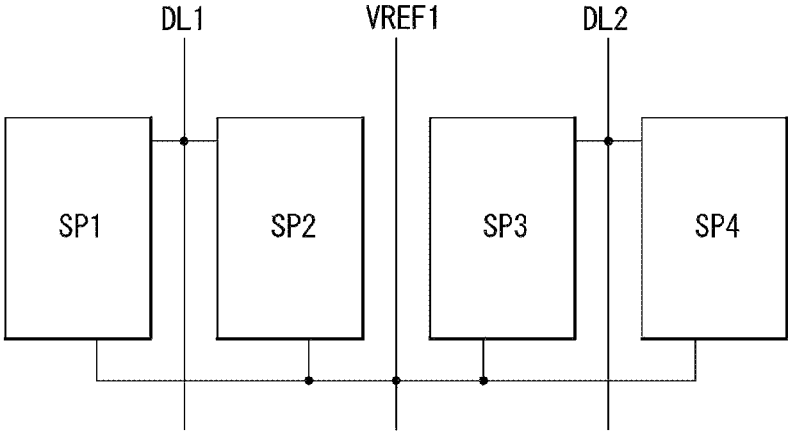

FIG. 3 is an equivalent circuit diagram showing a sub-pixel comprising a compensation circuit according to an exemplary embodiment of the present disclosure. FIGS. 4 and 5 are exemplary views of a pixel that can be implemented based on the sub-pixel of FIG. 3 according to embodiments of the present disclosure.

As shown in FIG. 3, a sub-pixel comprising a compensation circuit according to the exemplary embodiment of the present disclosure comprises a switching transistor SW, a sensing transistor ST, a driving transistor DT, a capacitor CST, and an organic light-emitting diode OLED.

A gate electrode of the switching transistor SW is connected to a 1A scan line GL1*a*, a first electrode thereof is connected to a first data line DL1, and a second electrode thereof is connected to a gate electrode of the driving transistor DT. The gate electrode of the driving transistor DT is connected to the capacitor CST, a first electrode thereof is connected to a first power supply line EVDD, and a second electrode thereof is connected to an anode of the organic light-emitting diode OLED.

A first electrode of the capacitor CST is connected to the gate electrode of the driving transistor DT, and a second electrode thereof is connected to the anode of the organic light-emitting diode OLED. The anode of the organic light-emitting diode OLED is connected to the second electrode of the driving transistor DT, and a cathode thereof is connected to a second power supply line EVSS.

A gate electrode of the sensing transistor ST is connected to a 1B scan line GL1*b*, a first electrode thereof is connected to a first sensing line VREF1, and a second electrode thereof is connected to the anode, which is a sensing node, of the organic light-emitting diode OLED. The sensing transistor ST is a compensation circuit added to sense degradation, threshold voltage, etc. in the driving transistor DT and organic light-emitting diode OLED. The sensing transistor ST obtains a sensed value through a sensing node defined between the driving transistor DT and the organic light-emitting diode OLED. The sensed value obtained from the sensing transistor ST is delivered to an external compensation circuit provided outside the sub-pixel through the first sensing line VREF1.

The 1A scan line GL1*a* connected to the gate electrode of the switching transistor SW and the 1B scan line GL1*b* connected to the gate electrode of the sensing transistor ST may be separated from each other as shown in the drawing, or may be connected together. Connecting the gate electrodes together can reduce the number of scan lines, and, as a result, prevent a decrease in aperture ratio caused by the addition of a compensation circuit.

As shown in FIGS. 4 and 5, first to fourth sub-pixels SP1 to SP4 each comprising a compensation circuit according to an exemplary embodiment of the present invention may be defined to form one pixel. The first to fourth sub-pixels SP1 to SP4 may be configured to emit light in red, green, blue, and white, respectively, but are not limited thereto.

As in the first example of FIG. 4, the first to fourth sub-pixels SP1 to SP4 each comprising a compensation circuit may be connected to share one sensing line, i.e., the first sensing line VREF1, and may be connected separately to the first to fourth data lines DL1 to DL4, respectively.

As in the second example of FIG. 5, the first to fourth sub-pixels SP1 to SP4 each comprising a compensation circuit may be connected to share one sensing line, i.e., the first sensing line VREF1, and may be connected in pairs to one data line. For example, the first and second sub-pixels SP1 and SP2 may share the first data line DL1, and the third and fourth sub-pixels SP3 and SP4 may share the second data line DL2.

However, FIGS. 4 and 5 show only two examples, and the present disclosure may be applicable to a display panel that has sub-pixel structures different than the one illustrated and explained above. Furthermore, the present disclosure is also applicable to a structure having a compensation circuit within a sub-pixel or a structure having no compensation circuit within a sub-pixel.

Figure 6:
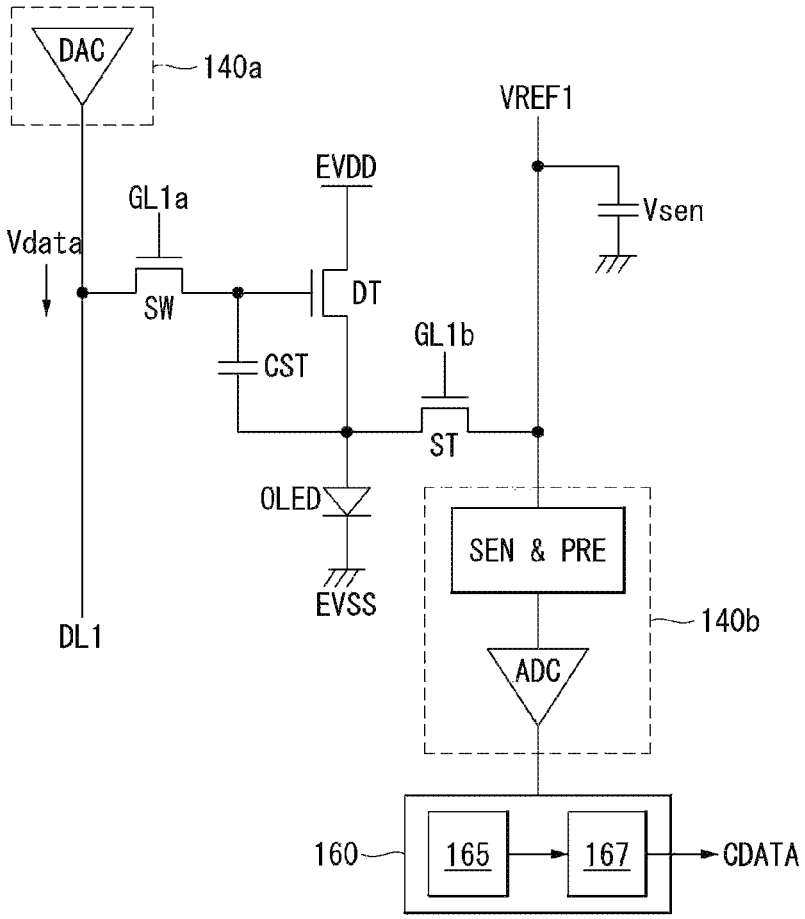
FIG. 6 is a view showing a first example of the main blocks of an organic light-emitting display, separately, according to an exemplary embodiment of the present disclosure.
Figure 7:
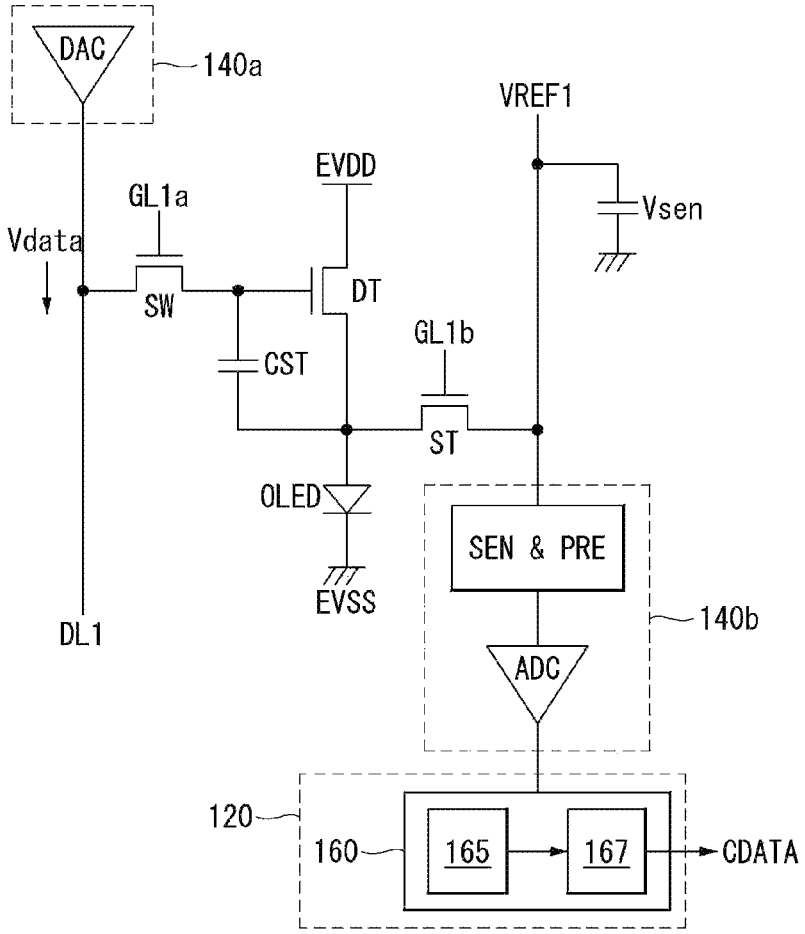
FIGS. 7 and 8 are views showing a second example of the main blocks of an organic light-emitting display, separately, according to an exemplary embodiment of the present disclosure.
Figure 8:
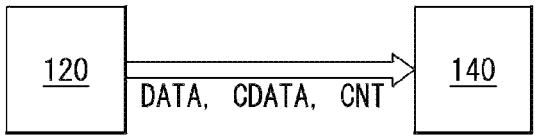

FIG. 6 is a view showing a first example of the main blocks of an organic light-emitting display, separately, according to an exemplary embodiment of the present disclosure. FIGS. 7 and 8 are views showing a second example of the main blocks of an organic light-emitting display, separately, according to an exemplary embodiment of the present disclosure.

As shown in FIG. 6, the organic light-emitting display according to the exemplary embodiment of the present disclosure comprises a circuit that supplies a data voltage to a sub-pixel, senses an element included in the sub-pixel, and generates a compensation value based on the sensed value.

The data driver 140*a* and 140*b* is a circuit that performs a driving operation such as supplying a data voltage to the sub-pixel and a sensing operation for sensing an element included in the sub-pixel, and may comprise a first circuit 140*a* and a second circuit 140*b*. However, an external compensation circuit such as the second circuit 140*b* may be configured as a separate unit.

The first circuit 140*a* is a circuit that outputs a data voltage Vdata for the driving operation of the sub-pixel, which may comprise a data voltage output part DAC. The data voltage output part DAC converts a digital data signal supplied from the timing controller to an analog voltage and outputs it. An output end of the data voltage output part DAC is connected to the first data line DL1. The data voltage output part DAC may output voltages (e.g., black voltage, etc.) required for compensation, as well as data voltages Vdata required for image representation.

The second circuit 140*b* is a circuit that outputs voltages required for sensing and switching operations, which may comprise a sensing and voltage charging part SEN & PRE and a sensed value conversion part ADC.

The sensing and voltage charging part SEN & PRE may sense the characteristics of an element included in the sub-pixel through the first sensing line VREF1. In an example, the sensing and voltage charging part SEN & PRE may sense the voltage stored in the line capacitor Vsen of the first sensing line VREF1 (parasitic capacitor formed along the first sensing line), and sense the characteristics of an element included in the sub-pixel. In another example, the sensing and voltage charging part SEN & PRE may sense a current flowing through a sensing node connected to the first sensing line VREF1, and sense the characteristics of an element included in the sub-pixel based on the sensed current value. In yet another example, the sensing and voltage charging part SEN & PRE may sense the charge accumulated in the parasitic capacitor of the organic light-emitting diode through the first sensing line VREF1, and sense the characteristics of an element included in the sub-pixel based on the sensed charge value. The sensed value conversion part ADC may convert an analog sensed value outputted from the sensing and voltage charging part SEN & PRE to a digital sensed value and output it. The sensing and voltage charging part SEN & PRE comprises a circuit part for sensing the first sensing line VREF1 and a circuit part for applying voltage to the first sensing line VREF1. A description related to this will be given later.

A compensation circuit 160 is a circuit that produces a compensation value based on the sensed values, along with image analysis, which may comprise an image analyzer 165 and a compensation value generator 167. The image analyzer 165 may act to analyze the sensed values outputted from the sensed value conversion part ADC, as well as externally input data signals. The compensation value generator 167 may act to determine the degree of degradation of a sensed element and generate a compensation value required for compensation, corresponding to an analysis result outputted from the image analyzer 165.

As shown in FIGS. 7 and 8, if the first circuit 140*a* and the second circuit 140*b* are included inside the data driver 140, the compensation circuit 160 may be included inside the timing controller 120. Thus, the timing controller 120 may supply the data driver 130 with a compensated data signal CDATA, which is obtained by compensating a data signal DATA based on a compensation value. Also, the timing controller 120 may supply the data driver 140 with a control signal CNT for controlling the first circuit 140*a* and the second circuit 140*b*.

Figure 9:
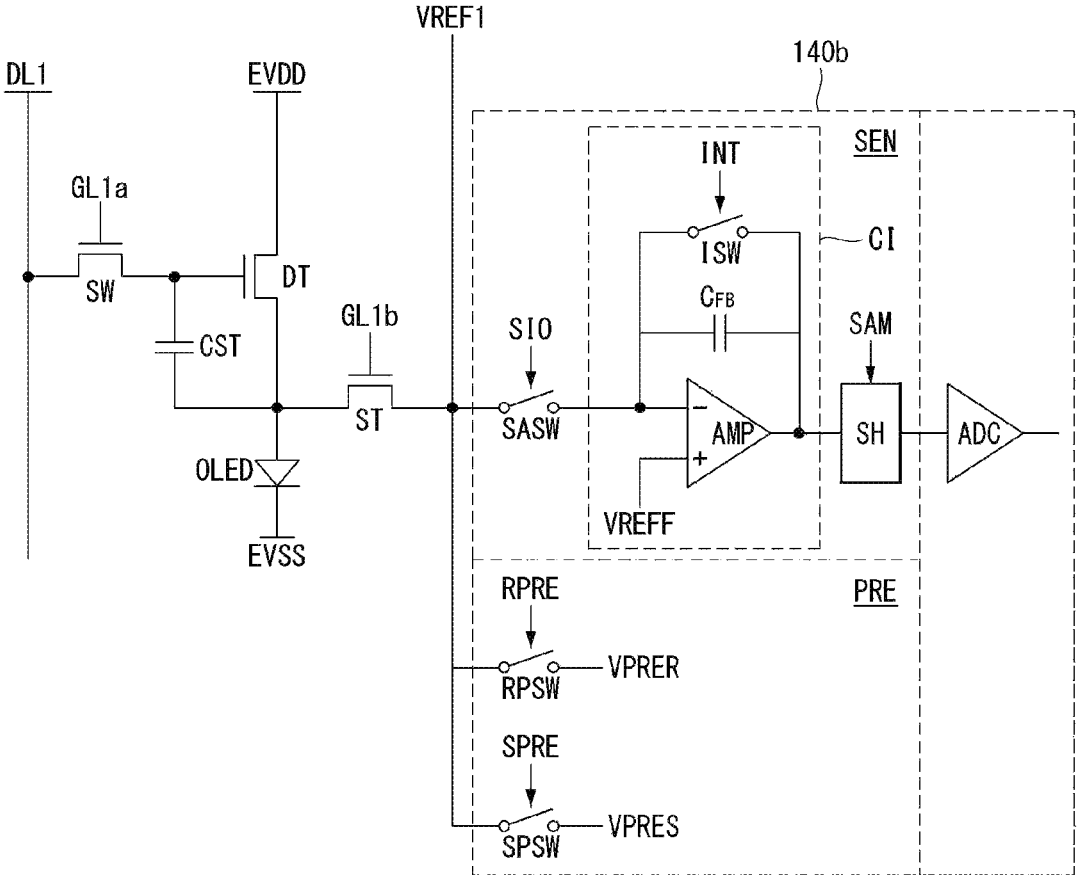
FIG. 9 is a view showing a sensing and voltage charging part of an organic light-emitting display according to an exemplary embodiment of the present disclosure.
Figure 10:
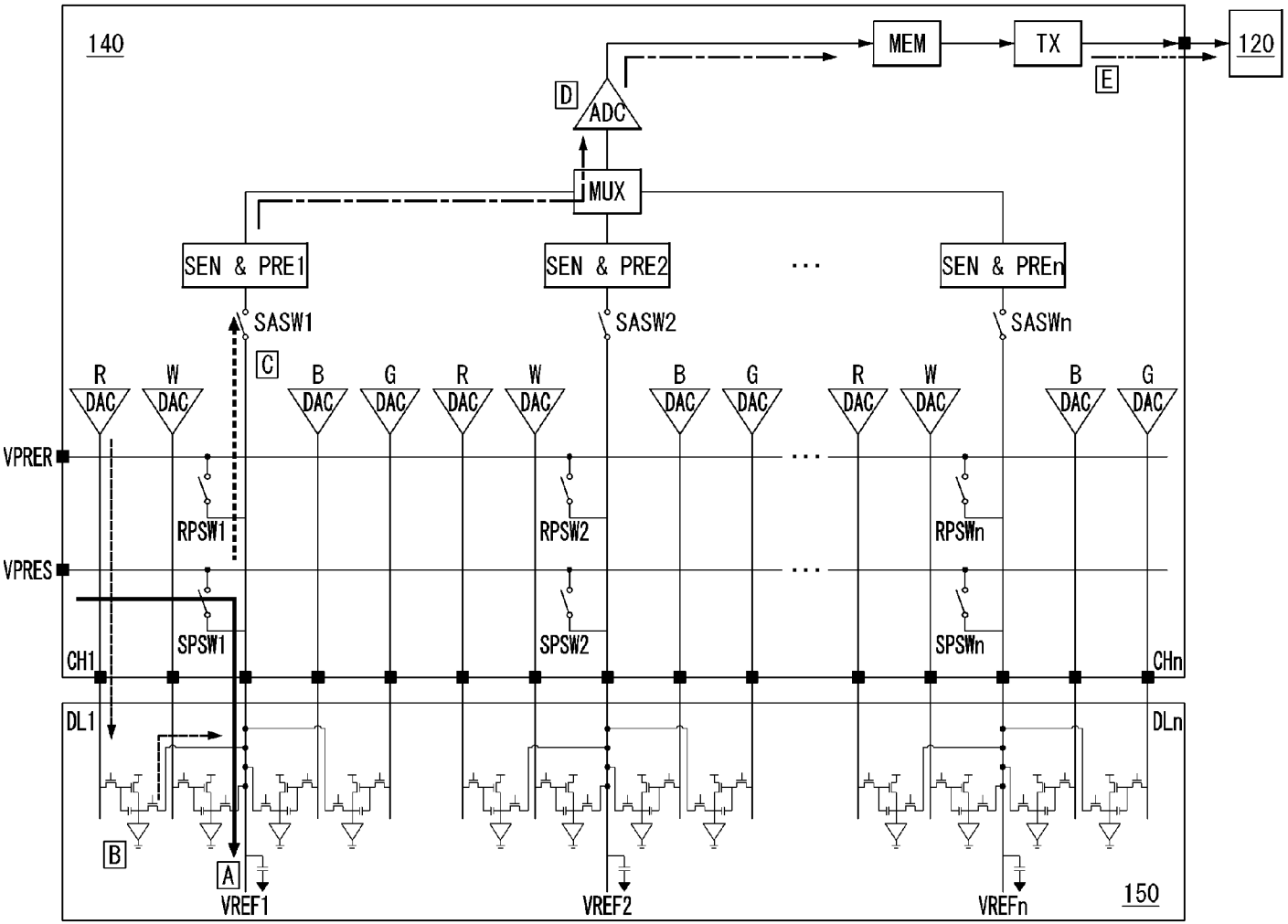
FIG. 10 is a view showing an internal block of a data driver according to an exemplary embodiment of the present disclosure.
Figure 11:
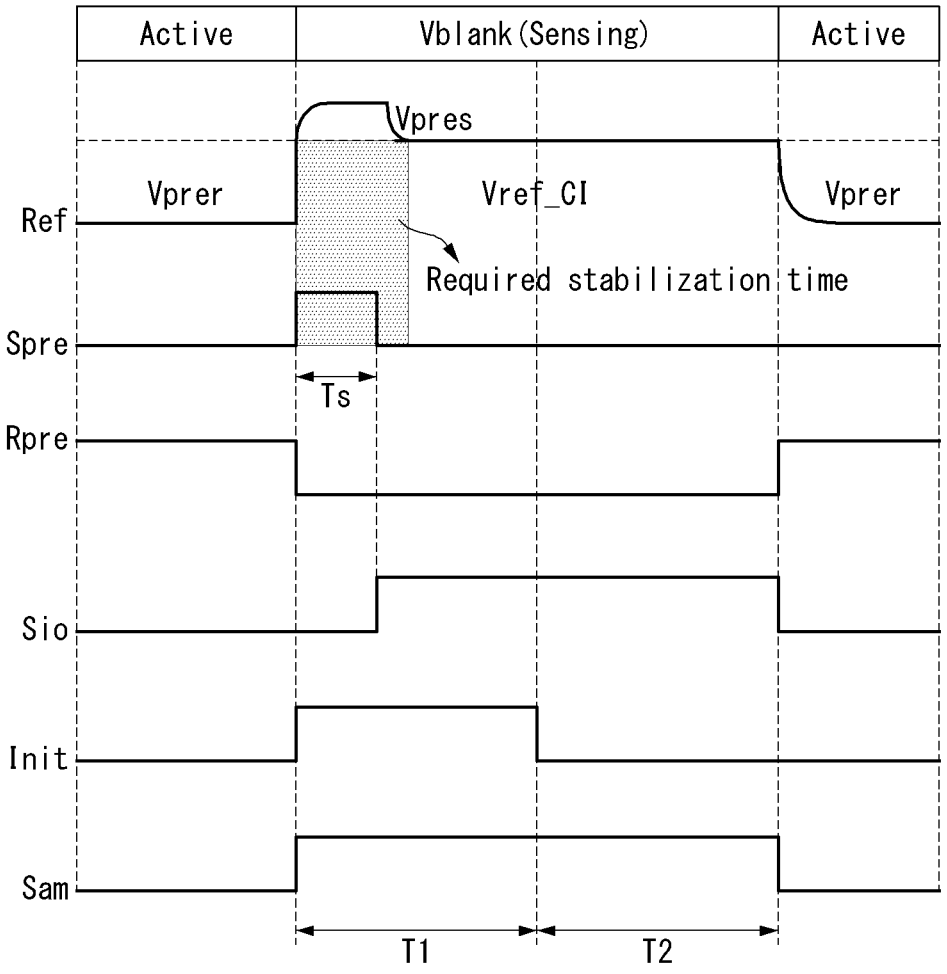
FIG. 11 is a driving waveform diagram of an organic light-emitting display according to an exemplary embodiment of the present disclosure.
Figure 12:
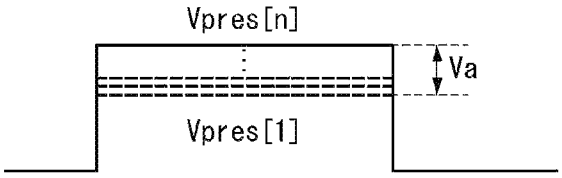
FIGS. 12 to 14 are views for explaining a method of applying an initial voltage according to embodiments of the present disclosure.
Figure 13:
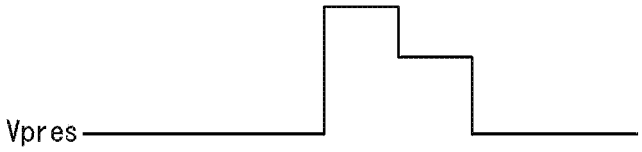
Figure 14:
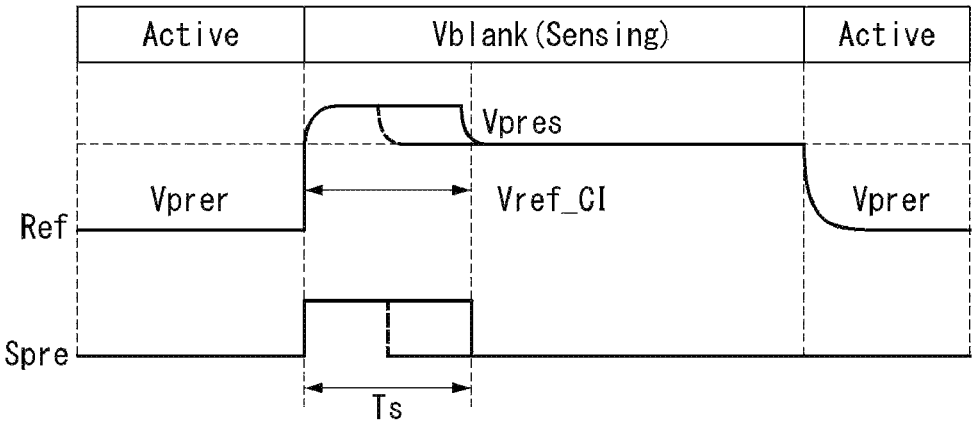

FIG. 9 is a view showing a sensing and voltage charging part SEN & PRE of an organic light-emitting display according to an exemplary embodiment of the present disclosure. FIG. 10 is a view showing an internal block of a data driver according to an exemplary embodiment of the present disclosure. FIG. 11 is a driving waveform diagram of an organic light-emitting display according to an exemplary embodiment of the present disclosure. FIGS. 12 to 14 are views for explaining a method of applying an initial voltage according to embodiments of the present disclosure.

As shown in FIG. 9, the sensing and voltage charging part SEN & PRE of the organic light-emitting display according to an exemplary embodiment of the present disclosure comprises a sensing circuit part SEN for sensing the first sensing line VREF1 and a voltage charging part PRE for applying voltage to the first sensing line VREF1.

The sensing circuit part SEN comprises a sensing switch part SASW, an integrated circuit part CI, and a sample and hold part SH.

The sensing switching part SASW turns on in response to a sensing start signal applied through a sensing start signal line SIO. When the sensing switch part SASW is turned on, the integrating circuit part CI may measure a current, voltage, charge, etc. through the first sensing line VREF1. The integrating circuit part CI comprises a circuit initial switch part ISW, an integrating capacitor $C_{FB}$, and an op-amp AMP. The integrating capacitor $C_{FB}$ and the op-amp AMP measure and integrate a current by sensing the first sensing line VREF1.

A gate electrode of the sensing switch part SASW is connected to the sensing start signal line SIO, a first electrode thereof is connected to the first sensing line VREF1, and a second electrode thereof is connected to an inverting terminal (−) of the op-amp AMP. A first electrode of the integrating capacitor $C_{FB}$ is connected to the inverting terminal (−) of the op-amp AMP, and a second electrode thereof is connected to an output terminal of the op-amp AMP. A gate electrode of the circuit initial switch part ISW is connected to a circuit initial signal line INT, a first electrode thereof is connected to the inverting terminal (−) of the op-amp AMP, and a second electrode thereof is connected to the output terminal of the op-amp AMP. A non-inverting terminal (+) of the op-amp AMP is connected to a reference voltage source VREFF, and the output terminal thereof is connected to an input terminal of the sample and hold part SH.

The sample and hold part SH is disposed between the integrating circuit part CI and the sensed value conversion part ADC. A control electrode of the sample and hold part SH is connected to a sampling control signal line SAM, the input terminal thereof is connected to the output terminal of the op-amp AMP, which is an output end of the integrating circuit part CI, and an output terminal thereof is connected to an input terminal of the sensed value conversion part ADC. The sample and hold part SH samples and holds a sensed value outputted from the integrating circuit part CI in response to a sampling control signal to obtain an analog sensed value and output it.

The voltage charging part PRE comprises an initial voltage output switch part SPSW, an initial voltage source VPRES, a driving voltage output switch part RPSW, and a driving voltage source VPRER.

The initial voltage output switch part SPSW outputs an initial voltage generated by the initial voltage source VPRES through the first sensing line VREF1. A gate electrode of the initial voltage output switch part SPSW is connected to a initial control signal line SPRE, a first electrode thereof is connected to the first sensing line VREF1, and a second electrode thereof is connected to the initial voltage source VPRES. The initial voltage output switch part SPSW is turned on or off in response to an initial control signal. The initial voltage generated by the initial voltage source VPRES may be a voltage between a first voltage (high-potential voltage) and a second voltage (low-potential voltage), but is normally a voltage close to the second voltage. The initial voltage source VPRES varies within a range between the first voltage (high-potential voltage) and the second voltage (low-potential voltage), under the control of an external device. The initial voltage is applied to establish a condition or environment appropriate for the first sensing line VREF1 to perform sensing.

The driving voltage output switch part RPSW outputs a driving voltage generated by the driving voltage source VPRER through the first sensing line VREF1. A gate electrode of the driving voltage output switch part RPSW is connected to a driving control signal line RPRE, a first electrode thereof is connected to the first sensing line VREF1, and a second electrode thereof is connected to the driving voltage source VPRER. The driving voltage switch part RPSW is turned on or off in response to a driving control signal. The driving voltage generated by the driving voltage source VPRER may be a voltage between a first voltage (high-potential voltage) and a second voltage (low-potential voltage), but is normally a voltage close to the second voltage. However, the driving voltage is generated at a different level from the initial voltage. The driving voltage is applied to establish a condition or environment appropriate to compensate for, recover, or drive an element through the first sensing line VREF1.

As shown in FIG. 10, the data driver 140 may comprise a data voltage output part DAC, first to Nth initial voltage output switch parts SPSW1 to SPSWn, the initial voltage source VPRES, first to Nth driving voltage output switch parts RPSW1 to RPSWn, the driving voltage source VPRER, first to Nth sensing switch parts SASW1 to SASWn, first to Nth sensing and voltage charging parts SEN & PRE1 to SEN & PREn, a mux part MUX, the sensed value conversion part ADC, a memory part MEM, and a signal transmission part TX.

The data voltage output part DAC is included in the first circuit of the data driver 140. The first to Nth initial voltage output switch parts SPSW1 to SPSWn, the initial voltage source VPRES, the first to Nth driving voltage output switch parts RPSW1 to RPSWn, the driving voltage source VPRER, the first to Nth sensing switch parts SASW1 to SASWn, the first to Nth sensing and voltage charging parts SEN & PRE1 to SEN & PREn, the mux part MUX, and the sensed value conversion part ADC are included in the second circuit of the data driver 140. The memory part MEM and the signal transmission part TX are included in a third circuit.

The data voltage output part DAC may comprise a red data voltage output part for outputting a red data voltage R, a white data voltage output part for outputting a white data voltage W, a blue data voltage output part for outputting a blue data voltage B, and a green data voltage output part for outputting a green data voltage G. The data voltage output part DAC may be connected to the data lines DL1 to DLn of the display panel 150 through individual output buffers for output channels CH1 to CHn of the data driver 140.

The first to Nth initial voltage output switch parts SPSW1 to SPSWn are arranged to respectively correspond to the first to Nth sensing lines VREF1 to VREFn. The first to Nth initial voltage output switch parts SPSW1 to SPSWn may output an initial voltage generated by the initial voltage source VPRES through the first to Nth sensing lines VREF1 to VREFn, respectively.

The first to Nth driving voltage output switch parts RPSW1 to RPSWn are arranged to respectively correspond to the first to Nth sensing lines VREF1 to VREFn. The first to Nth driving voltage output switch parts RPSW1 to RPSWn may output a driving voltage generated by the driving voltage source VPRER through the first to Nth sensing lines VREF1 to VREFn, respectively.

The first to Nth sensing switch parts SASW1 to SASWn are disposed between the first to Nth sensing lines VREF1 to VREFn and the first to Nth sensing and voltage charging parts SEN & PRE1 to SEN & PREn, respectively. The first to Nth sensing switch parts SASW1 to SASWn may be turned on to sense at least one of the first to Nth sensing lines VREF1 to VREFn.

The first to Nth sensing and voltage charging parts SEN & PRE1 to SEN & PREn are disposed between the first to Nth sensing switch parts SASW1 to SASWn and an input terminal of the mux part MUX. The first to Nth sensing and voltage charging parts SEN & PRE1 to SEN & PREn may sense and sample a sensed value delivered through their turned-on sensing switch parts and deliver it to the mux part MUX.

The mux part MUX is disposed between the first to Nth sensing and voltage charging parts SEN & PRE1 to SEN & PREn and the sensed value conversion part ADC. The mux part MUX comprises a plurality of mux switch parts. The mux part MUX may obtain a sensed value delivered from at least one of the first to Nth sensing and voltage charging parts SEN & PRE1 to SEN & PREn in a time-sharing manner and deliver the sensed value to the sensed value conversion part ADC.

The sensed value conversion part ADC is disposed between the MUX part MUX and the memory part MEM. The sensed value conversion part ADC converts an analog sensed value to a digital sensed value and delivers it to the memory part MEM. The memory part MEM stores at least one sensed value delivered from the sensed value conversion part ADC and then delivers it to the single transmission part TX. The signal transmission part TX transmits the sensed value, etc. delivered from the memory part MEM to the timing controller 120. An example of a sensing process based on what has been described above and the flow of the sensing process are as shown in (A) through (E) of FIG. 10.

As shown in FIGS. 9 to 11, a logic-high driving control signal Rpre is applied to the driving control signal line RPRE during an active period Active during which an image is displayed on the display panel 150. At least one of the first to Nth driving voltage output switch parts RPSW1 to RPSWn turns on in response to the logic-high driving control signal Rpre, and a driving voltage Vprer is outputted through the turned-on switch part. Thus, at least one of the first to Nth sensing lines VREF1 to VREFn is charged with the driving voltage Vprer.

A logic-high initial control signal Spre is applied to the initial control signal line SPRE during a blanking interval (or sensing interval) Vblank during which no image is displayed on the display panel 150. The driving control signal Rpre is maintained in logic low state during the blanking interval (or sensing interval) Vblank. A logic-high sensing start signal Sio is applied to the sensing start signal line SIO during the blanking interval, a logic-high circuit initial signal Init is applied to the circuit initial signal line INT, and a sampling control signal Sam is applied to the sampling control signal line SAM.

The initial control signal Spre, circuit initial signal Init, and sampling control signal Sam may be generated at logic high at the same time as they enter the blanking interval Vblank. That is, the initial control signal Spre, circuit initial signal Init, and sampling control signal Sam are switched from logic low to logic high, in synchronization with the blanking interval Vblank. The initial control signal Spre is generated at logic-high temporarily only during an initial time Ts before the sensing start signal Sio is generated at logic high. The initial time Ts may be defined as shorter than a first time T1 during which the circuit initial signal Init is maintained at logic high. Although the initial voltage output switch parts and the circuit initial switch parts are simultaneously turned on, the turn-on time of the initial voltage output switch parts is shorter than the turn-on time of the initial voltage output switch parts. The circuit initial signal Init is generated at logic high only during the first time T1. The first time T1 during which the circuit initial signal Init is maintained at logic high and a second time T2 during which the circuit initial signal Init is maintained at logic low are illustrated as ½ the blanking interval, but are not limited thereto. The sampling control signal Sam is maintained at logic high during the blanking interval Vblank.

An initial voltage Vpres is applied at a different voltage level from a target voltage Vref_CI (or reference voltage) of the integrating circuit part CI during the initial time Ts during which the initial control signal Spre is maintained at logic high. For example, if the target voltage Vref_CI of the integrating circuit part CI is 2.5 V, the initial voltage Vpres applied during the initial time Ts is higher than that, i.e., 4.5 V. As a result, the voltage Ref of the first sensing line VREF1 is stabilized to a voltage level corresponding to the target voltage Vref_CI of the integrating circuit part CI, after the initial voltage Vpres having a higher level than the driving voltage Vprer is applied.

In the process of initializing the integrating circuit part CI, noise occurs due to various parasitic components present on the display panel 150. In view of this nature, when the integrating circuit part CI is initialized, the reset voltage Vpres is applied as a different voltage from the target voltage Vref_CI of the integrating circuit part CI, so that the noise introduced into the display panel can be cancelled out within a short time and therefore it does not take a long stabilization time. That is, stabilization (line stabilization) normally takes a lengthy amount of time, about the second time T2 during which the circuit initial signal Init is switched to logic low, whereas, according to the exemplary embodiment, the stabilization time is shorter, corresponding to the level of the initial voltage Vpres applied during the initial time Ts. Although the initial voltage Vpres is described as different from the target voltage Vref_CI of the integrating, it can be defined more specifically as a noise removing voltage which can cancel out noise.

As shown in FIG. 12, the initial voltage Vpres is not fixed to one level but may have varying levels, for example, from the first to Nth initial voltages Vpres[1] to Vpres[n]. Moreover, as shown in FIG. 13, the initial voltage Vpres may be applied in the form of step voltage levels. In this way, by applying the initial voltage Vpres at various levels or in various forms, rather than at a fixed level, adaptive voltage variation can be done depending on the noise introduced into the display panel, thereby providing a basis for improving sensing accuracy. More than anything else, the initial time can be reduced during the sensing period.

As shown in FIG. 14, the initial time T2 during which the initial voltage Vpres is applied is not fixed but may vary. In this way, by varying the time for applying the initial voltage Vpres, adaptive voltage variation can be done depending on the stabilization time required for each display panel or the noise introduced into the display panel, without a large amount of variation in voltage, thereby providing a basis for improving sensing accuracy.

As can be seen from FIGS. 12 to 14, the voltage level or apply time of the initial voltage Vpres may be determined in response to a voltage change (voltage level change) across the sensing line which may occur in a transition from the active period Active to the blanking interval Vblank. Also, as can be seen from the description of FIGS. 7 to 10, the voltage level or application time of the initial voltage Vpres may be changed in response to a control signal CNT outputted from the timing controller 120.

FIGS. 15 to 20 are views for comparatively explaining an organic light-emitting display according to a test example and an organic light-emitting display according to an exemplary embodiment of the present disclosure.

Figure 15:
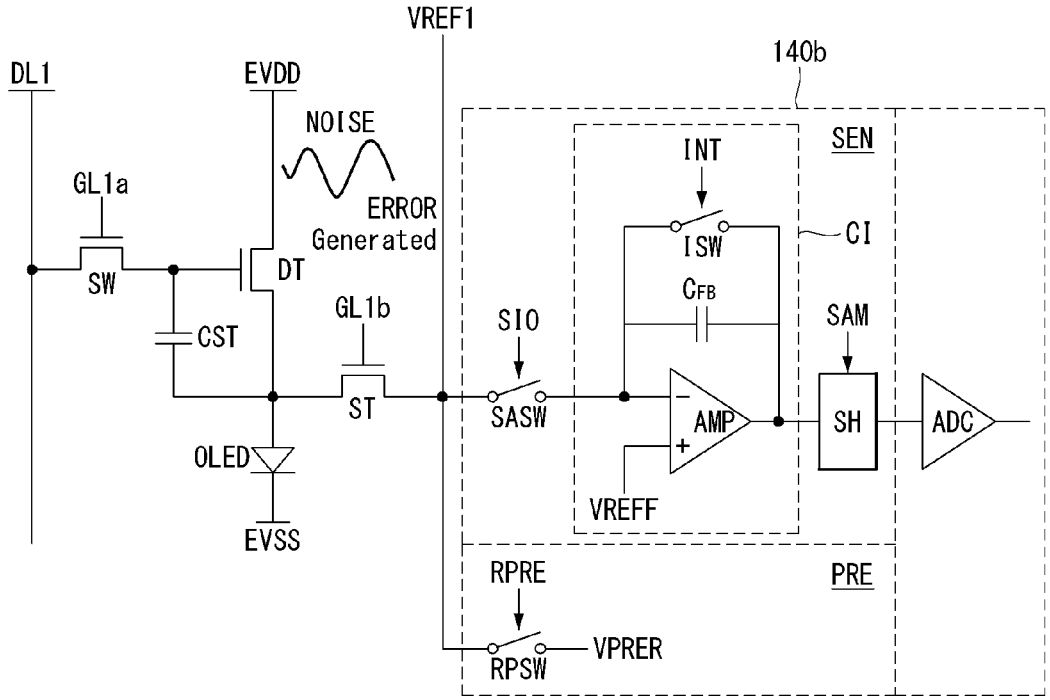
FIGS. 15 to 20 are views for comparatively explaining an organic light-emitting display according to a test example and an organic light-emitting display according to an exemplary embodiment of the present disclosure.
Figure 16:
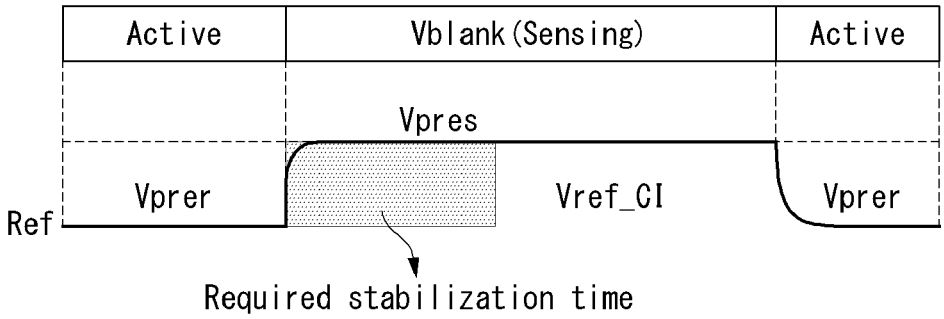
Figure 17:
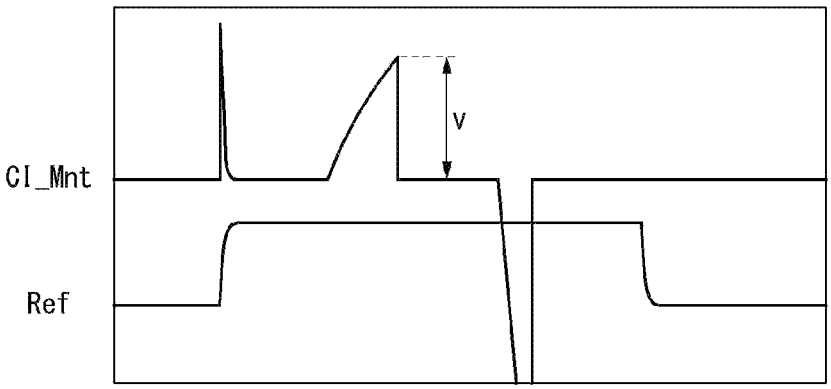

As shown in FIGS. 15 and 16, in the organic light-emitting display according to the test example, the initial voltage Vpres is applied at a voltage level similar or equal to the target voltage Vref_CI (or reference voltage) of the integrating circuit part CI during the blanking interval (or sensing period) Vblank. That is, in the test example, the initial voltage Vpres is not varied.

When applying the initial voltage Vpres at a voltage level similar or equal to the target voltage Vref_CI (or reference voltage) of the integrating circuit part CI as in the test example, it takes a long time until noise due to parasitic components is cancelled out. Moreover, when applying the initial voltage Vpres at a voltage level similar or equal to the target voltage Vref_CI (or reference voltage) of the integrating circuit part CI as in the test example, a high impulse voltage V is monitored through the integrating circuit part as in "CI_Mnt" of FIG. 17, due to the effect of noise.

Figure 18:
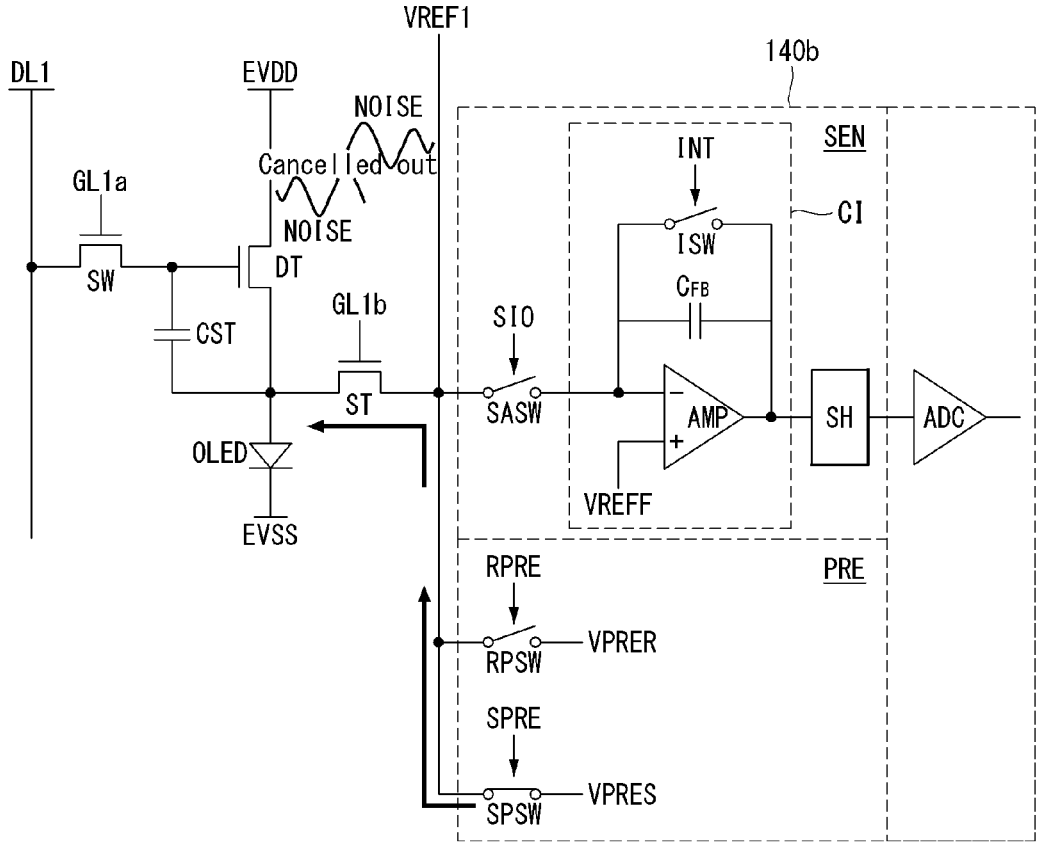
Figure 19:
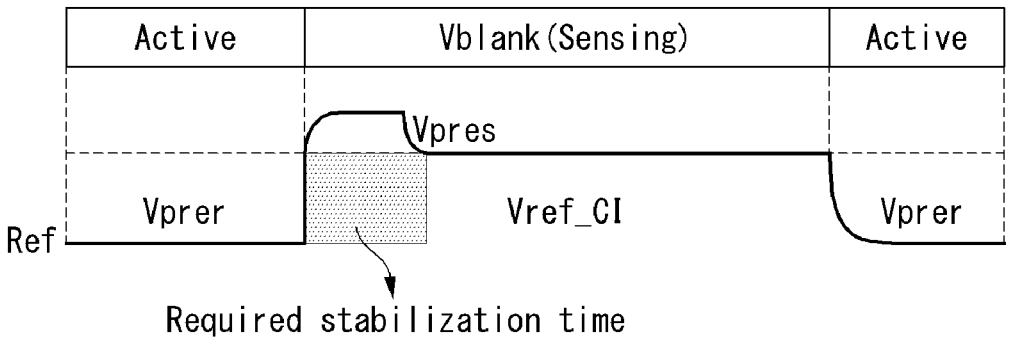
Figure 20:
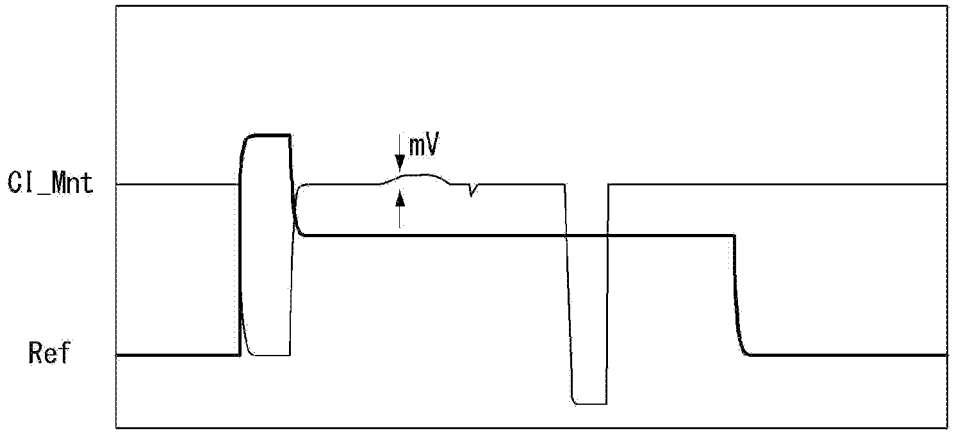

As shown in FIGS. 18 and 19, in the organic light-emitting display according to the exemplary embodiment, the initial voltage Vpres is applied at a higher voltage level than the target voltage Vref_CI (or reference voltage) of the integrating circuit part CI during the blanking interval (or sensing period) Vblank.

When applying the initial voltage Vpres at a higher voltage level than the target voltage Vref_CI (or reference voltage) of the integrating circuit part CI as in the exemplary embodiment, noise due to parasitic components is cancelled out within a short time. Moreover, when applying the initial voltage Vpres at a higher voltage level than the target voltage Vref_CI (or reference voltage) of the integrating circuit part CI as in the exemplary embodiment, a significantly lower voltage V compared to the test example is monitored through the integrating circuit part as in "CI_Mnt" of FIG. 20, since noise is cancelled out.

Meanwhile, if initializing is done ideally during the blanking interval (or sensing period) Vblank, a voltage close to 0 is monitored at an output terminal of the integrating circuit part CI. As can be seen by comparing "CI_Mnt" of FIG. 17 and "CI_Mnt" of FIG. 20, the exemplary embodiment allows for forming a voltage close to 0 at the output terminal of the integrating circuit part CI by applying artificial coupling noise. That is, in the exemplary embodiment, noise introduced into the display panel can be effectively cancelled out by applying artificial coupling noise.

According to the exemplary embodiment, the initial voltage Vpres is opposite in polarity to a voltage that causes noise on the sensing line. Moreover, the initial voltage Vpres may be a voltage that has the same amplitude as noise to cancel out the noise.

Figure 21:
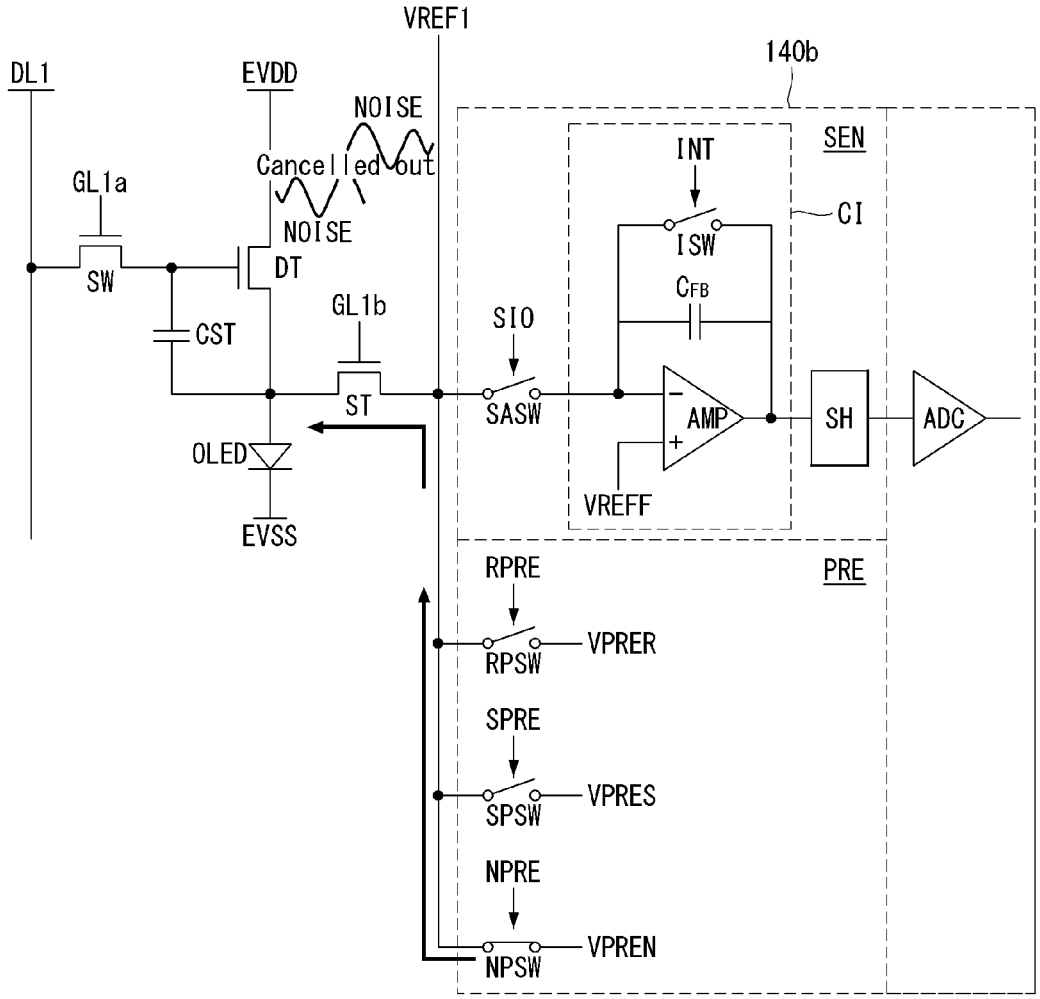
FIG. 21 is a view showing a sensing and voltage charging part of an organic light-emitting display according to another exemplary embodiment of the present disclosure.

FIG. 21 is a view showing a sensing and voltage charging part of an organic light-emitting display according to another exemplary embodiment of the present disclosure.

As shown in FIG. 21, the sensing and voltage charging part SEN & PRE of the organic light-emitting display according to another exemplary embodiment of the present disclosure comprises a sensing circuit part SEN for sensing the first sensing line VREF1 and a voltage charging part PRE for applying voltage to the first sensing line VREF1. A description of another exemplary embodiment will be focused on the differences in the configuration of the voltage charging part PRE compared to the foregoing exemplary embodiment.

The voltage charging part PRE comprises a initial voltage output switch part SPSW, an initial voltage source VPRES, a driving voltage output switch part RPSW, a driving voltage source VPRER, a noise removing switch part NPSW, and a varying voltage source VPREN.

The initial voltage output switch part SPSW outputs an initial voltage generated by the initial voltage source VPRES through the first sensing line VREF1. A gate electrode of the initial voltage output switch part SPSW is connected to an initial control signal line SPRE, a first electrode thereof is connected to the first sensing line VREF1, and a second electrode thereof is connected to the initial voltage source VPRES. The initial voltage output switch part SPSW is turned on or off in response to an initial control signal. The initial voltage generated by the initial voltage source VPRES may be a voltage between a first voltage (high-potential voltage) and a second voltage (low-potential voltage), but is normally a voltage close to the second voltage. The initial voltage source VPRES varies within a range between the first voltage (high-potential voltage) and the second voltage (low-potential voltage), under the control of an external device. The initial voltage is applied to establish a condition or environment appropriate for the first sensing line VREF1 to perform sensing.

The driving voltage output switch part RPSW outputs a driving voltage generated by the driving voltage source VPRER through the first sensing line VREF1. A gate electrode of the driving voltage output switch part RPSW is connected to a driving control signal line RPRE, a first electrode thereof is connected to the first sensing line VREF1, and a second electrode thereof is connected to the driving voltage source VPRER. The driving voltage switch part RPSW is turned on or off in response to a driving control signal. The driving voltage generated by the driving voltage source VPRER may be a voltage between a first voltage (high-potential voltage) and a second voltage (low-potential voltage), but is normally a voltage close to the second voltage. However, the driving voltage is generated at a different level from the initial voltage. The driving voltage is applied to establish a condition or environment appropriate to compensate for, recover, or drive an element through the first sensing line VREF1.

The noise removing switch part NPSW outputs a varying voltage generated by the varying voltage source VPREN through the first sensing line VREF1. A gate electrode of the noise removing switch part NPSW is connected to a noise removing signal line NPRE, a first electrode thereof is connected to the first sensing line VREF1, and a second electrode thereof is connected to the varying voltage source VPREN. The noise removing switch part NPSW is turned on or off in response to a noise removing signal. The varying voltage generated by the varying voltage source VPREN is opposite in polarity to a voltage that causes noise on the first sensing line VREF1. Moreover, the varying voltage may be a voltage that has the same amplitude as noise to cancel out the noise.

In another exemplary embodiment, the noise removing switch part NPSW operates only when noise is detected on the first sensing line VREF1, and, at the same time, the voltage outputted from the varying voltage source VPREN varies. Noise detection can be done only by analyzing the voltage outputted through the integrating circuit part CI. By operating the noise removing switch part NPSW and the varying voltage source VPREN only when noise is generated, as in another exemplary embodiment, there is no need to increase the level of the initial voltage for each sensing period, thus reducing power consumption.

As above, the present disclosure offers the advantage of improving sensing accuracy by removing noise introduced into the display panel in a sensing operation for compensating for degradation of an element included in a sub-pixel by an external compensation circuit. Moreover, the present disclosure offers the advantage of reducing initial time during a sensing period for compensating for degradation of the element. Furthermore, the present disclosure offers the advantage of implementing a compensation circuit robust to noise.

What is claimed is:

1. A light-emitting display comprising:

a display panel comprising a pixel;

a first circuit which supplies a data voltage to a data line for the pixel; and a second circuit which performs a sensing operation for sensing a sensing line for the pixel and outputs a voltage required for the sensing operation, wherein the second circuit outputs a noise removing voltage for cancelling out noise formed on the sensing line during the sensing operation, wherein the second circuit comprises:

a sensing switch part connected to the sensing line;

a noise remove voltage source for outputting the noise removing voltage through the sensing switch part; and an integrating circuit part which senses the sensing line through the sensing switch part between the sensing line and the integrating circuit part.

2. The light-emitting display of claim 1, wherein a level of the noise removing voltage varies in response to the noise.

3. The light-emitting display of claim 1, wherein an apply time of the noise removing voltage varies in response to the noise.

4. The light-emitting display of claim 1, wherein the noise removing voltage is applied for a shorter time than an initial time of the integrating circuit part included in the second circuit.

5. The light-emitting display of claim 1, wherein the second circuit further comprises:

a circuit initial switch part which resets the integrating circuit part; and a noise removing switch part connected to the sensing line.

6. The light-emitting display of claim 5, wherein the noise removing switch part and the circuit initial switch part are simultaneously turned on.

7. The light-emitting display of claim 6, wherein a turn-on time of the noise removing switch part is shorter than a turn-on time of the circuit initial switch part.

8. The light-emitting display of claim 5, wherein the noise removing voltage has a different voltage level from a reference voltage for the integrating circuit part.

9. The light-emitting display of claim 5, wherein a level and an apply time of the noise removing voltage are varied by a timing controller for controlling the first circuit and the second circuit.

10. A method of driving a light-emitting display comprising a display panel that displays an image during an active period and performs sensing during a blanking interval, the method comprising:

turning on a sensing switch part connected to a sensing line on the display panel during the blanking interval;

sensing the sensing line through the sensing switch part between the sensing line and an integrating circuit part;

outputting a noise removing voltage through the sensing switch part; and sensing the sensing line.

11. The method of claim 10, wherein a level of the noise removing voltage varies in response to the noise.

12. The method of claim 10, wherein an apply time of the noise removing voltage varies in response to the noise.

13. The method of claim 10, wherein a level and an apply time of the noise removing voltage are varied in response to the noise.

14. The method of claim 10, wherein the noise removing voltage is applied for a shorter time than an initial time of the integrating circuit part.

* * * * *